United States Patent [19]

Davidson

[11] 4,091,469

[45] May 30, 1978

[54] HEAD PROTECTOR FOR USE WITH HARD HEAD GEAR

[76] Inventor: Jacob Davidson, The Philadelphian, Apt. 6A10, 2401 Pennsylvania Ave., Philadelphia, Pa. 19130

[21] Appl. No.: 755,106

[22] Filed: Dec. 28, 1976

[51] Int. Cl.[2] ..... A42B 1/06

[52] U.S. Cl. ..... 2/410; 2/423

[58] Field of Search ..... 2/410–425, 2/5, 6, 205

[56] References Cited

U.S. PATENT DOCUMENTS

| | | | |
|---|---|---|---|
| 3,100,896 | 8/1963 | Khanbegian | 2/5 |
| 3,146,462 | 9/1964 | Militello | 2/410 |
| 3,205,508 | 9/1965 | Cox | 2/410 |
| 3,594,814 | 7/1971 | Schuessler et al. | 2/410 |

*Primary Examiner*—Alfred R. Guest

*Attorney, Agent, or Firm*—Caesar, Rivise, Bernstein & Cohen, Ltd.

[57] ABSTRACT

A removable weather protective covering for hard head gear, such head gear including a crowned portion terminating in a free edge from which a brim extends. The covering comprises a flexible tubular portion including a front panel formed of an elastic material and rear panel formed of a waterproof material. An elastic opening is provided in the top of the tubular portion and enables the tubular portion to be slipped over the crown of the head gear with a portion of the crown extending through the opening and with the elastic front panel being disposed over and accommodating the brim. The rear panel includes a pair of flaps extending downward on opposite sides and joined at the rear thereof by a web portion. The flaps include VELCRO fastening means adjacent their free ends so as to be readily connectible. When the covering is disposed over the hard head gear and the flaps are secured together adjacent the wearer's chin the flaps and connecting web cover the sides of the wearer's face and the back of the wearer's head and neck, thereby protecting the wearer from cold or wet weather conditions. The front panel of the tubular portion of the covering is preferably formed of a knitted elastic fabric while the rear panel is formed of a relatively inelastic panel and is florescent in color.

5 Claims, 5 Drawing Figures

FIG. 1
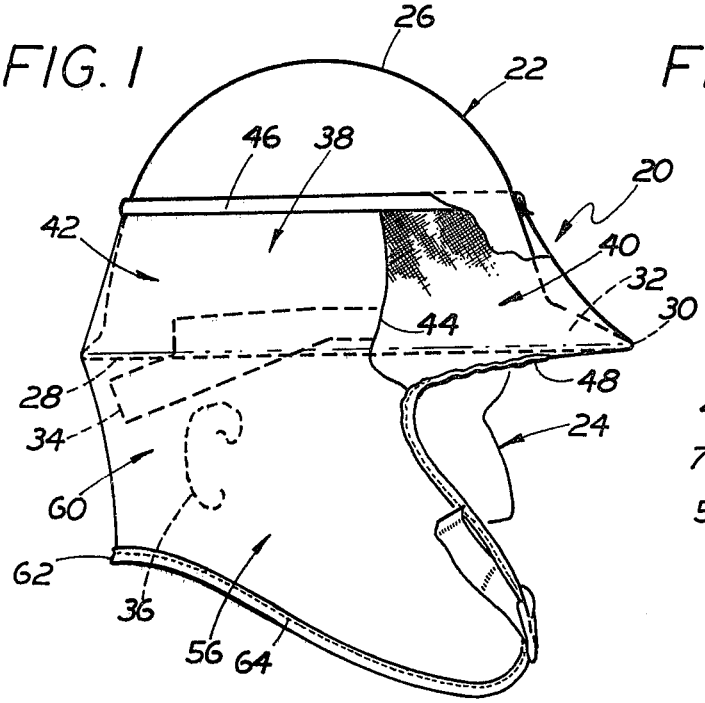
FIG. 2
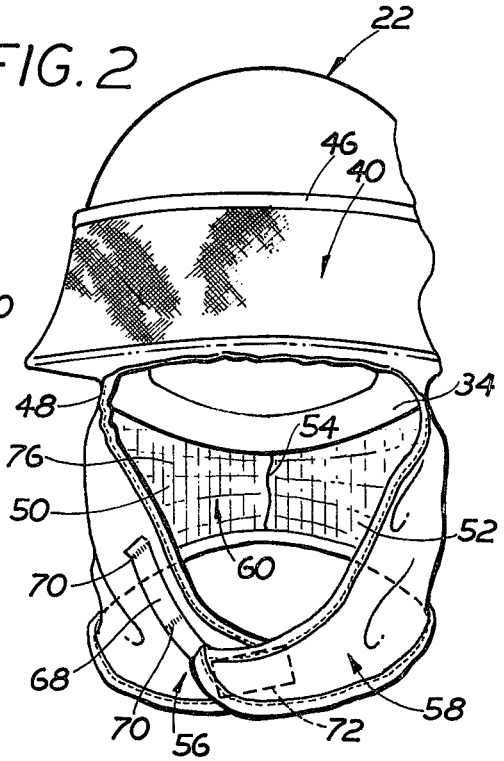
FIG. 3
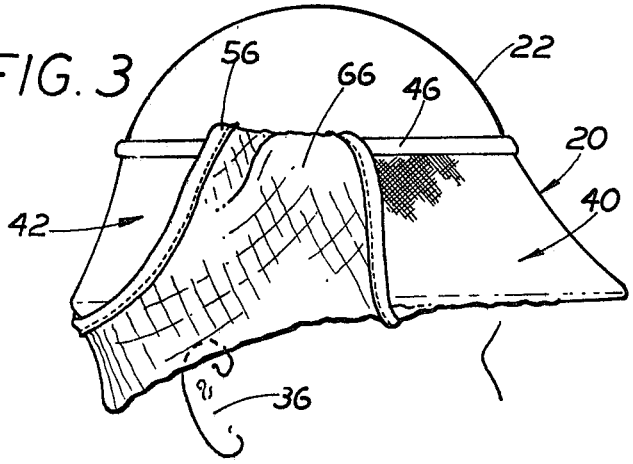
FIG. 4
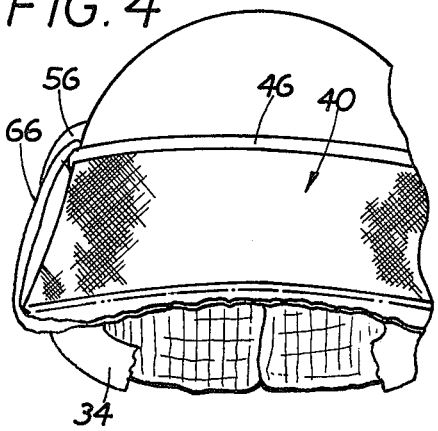
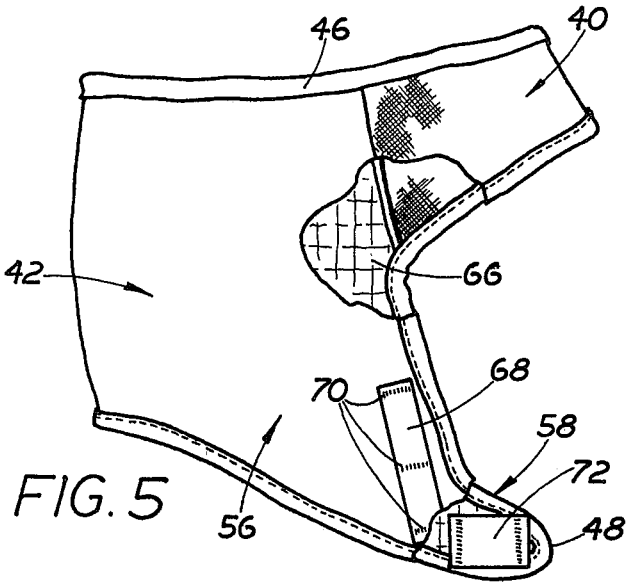
FIG. 5

HEAD PROTECTOR FOR USE WITH HARD HEAD GEAR

This invention relates generally to protective headwear and more particularly to attachments for hard head gear to protect the wearer's head and neck from cold, wet or otherwise inclement weather conditions.

Hard caps and hats, hereinafter referred to generally as hard head gear, are frequently worn by outdoor workers engaged in potentially hazardous activities to protect their heads from an accidental blow. Such head gear basically includes a crowned dome which is disposed over the wearer's head and terminates in a peripheral free edge disposed slightly above the wearer's ears. The front of the free edge terminates in a projecting brim or visor. Most hats commercially available today are formed as an integral unit of strong plastic material to be relatively impervious to impact.

While such head gear is effective to protect the wearer's head from impact, it is of minimal utility in protecting the head and neck of the wearer from foul weather, e.g., rain, sleet, snow, cold, etc. To that end, various adjunctive devices or attachments have been proposed in the patent literature to provide some weather protection for wearers of conventional hard head gear. For example, in U.S. Pat. No. 3,146,462 (Militello) there is disclosed a cold weather attachment for hard hats in the form of a woven band. The band is adapted to be slipped over the crown and brim of the hat. A portion of the band extends under the hat to close the space between the wearer's head and the interior of the hat. For additional protection the band may be pulled down slightly in the rear to cover a portion of the back of the wearer's head as well as both ears.

The device of the Militello patent, while offering some protection from cold weather, nevertheless leaves much to be desired from a utility standpoint. For example, the band of the Militello attachment is of a relatively limited width, apparently to prevent obstructing the vision of the wearer when in place, and due to the limited width of the band does not cover the nape of the wearer's neck. Needless to say, this characteristic renders the device of limited utility. In addition, owing to the fact that the entire band is elastic it may tend to roll or ride up, particularly when worn by persons engaged in strenous physical activity, thereby unnecessarily exposing portions of the wearer's head and neck to the elements. Furthermore, even the limited width portion of the band which does cover portions of the wearer's head and neck is not an effective water shield due to the fact that the band is not waterproof. In fact the knitted nature of the band renders it relatively absorbent and hence susceptible to water soakage (which may occur in heavy rain conditions).

In U.S. Pat. No. 3,100,896 (Khanbegian) there is disclosed an attachment for hard head gear, which, unlike the attachment of the Militello patent, provides coverage of all of the wearer's head and neck, except for the fact. To that end, the attachment of Khanbegian comprises a tubular body of flexible material which is somewhat stretchable and ostensibly impervious to air. The tubular body includes a face opening. The attachment is adapted to be pulled down over the hard head gear and over the wearer's head and neck, with the wearer's face extending through the face opening in the tubular body.

While the attachment of the Khanbegian patent appears effective to protect the wearer's head from cold weather, it is not sufficient to protect the wearer from wet conditions since it is not formed of a waterproof material. In addition, and perhaps more importantly, the sock-like tubular constructing renders the donning and the removal, be it partial or full, of the Khanbegian attachment quite cumbersome since the attachment must be pulled over the wearer's head.

Accordingly, it is a general object of the instant invention to provide an attachment for hard head gear which overcomes the disadvantages of the prior art.

It is a further object of the instant invention to provide an attachment for hard head gear which is simple in construction and inexpensive to make.

It is still a further object of the instant invention to provide an attachment for hard head gear which is effective for protecting the head of the wearer from all types of inclement weather conditions.

It is yet a further object of the instant invention to provide an attachment for hard head gear which can be put on and taken off with a minimum of effort and manipulation.

These and other objects of this invention are achieved by providing for use in combination with hard head gear including a crowned portion terminating in a free edge which forms a brim, a removable weather protective covering. The covering comprises a flexible tubular portion having a front panel formed of an elastic material and a rear panel formed of a waterproof material. The tubular portion also includes an elastic opening which is adapted to be disposed over the head gear with the crowned portion thereof extending through the elastic opening and with the elastic front panel of the covering disposed over and accommodating the brim. The rear panel also includes a pair of flaps extending downward from the tubular portion on opposite sides thereof and is joined at the rear by a web portion. The flaps include readily disconnectible connection means at their free ends to enable the flaps to be connected adjacent to the wearer's chin. When connected thusly the flaps and the connecting web cover the entire head and neck of the wearer except for the wearer's face.

Other objects and many of the attendant advantages of the instant invention will be readily appreciated as the same becomes better understood by reference to the following detailed description when considered in connection with the accompanying drawing wherein:

FIG. 1 is a side elevational view of the covering of the instant invention shown in place on a typical hard cap;

FIG. 2 is a front elevational view of the covering shown in FIG. 1;

FIG. 3 is a side elevational view of the covering shown in FIG. 1 with portions thereof folded up when not in use;

FIG. 4 is a front elevational view of the covering in the disposition shown in FIG. 3; and FIG. 5 is a side elevational view, partially in section, showing the covering of the instant invention when it is not disposed on a hard head gear.

Referring now to the various figures of the drawing wherein like reference characters refer to like parts, there is shown in FIG. 1 an improved covering 20 for disposition on a hard head gear 22 to protect the wearer 24 from adverse weather conditions, such as cold, water, sleet, hail, etc.

The head gear 22 is of conventional construction and is formed of a rigid material, such as hard plastic, to be relatively impervious to accidental blows. To that end, the head gear includes a crowned portion 26 which terminates in a rim 28. The rim projects outward from the front of the crown at 30 to form a brim 32. Disposed within the interior of the crown is a liner or support member 34 for supporting the head gear on the wearer's head. When in place the crown 26 covers the top portion of one's head, with the rim 28 lying adjacent (usually slightly above) one's ears 36.

While the head gear 22 is effective for protecting the upper portion of the head from impact, it is clear that such gear does not afford meaningful weather protection to those portions of the wearer's head not covered by the crown, e.g., the sides of the face or and the entire neck and back of the head.

However, with the covering 20 of the instant invention disposed on the head gear 22 virtually all of the wearer's head and neck is covered and hence adequately protected from the elements.

The covering 20 of the instant invention basically comprises a tubular portion 38 adapted for disposition over the crown of the head gear and including a front panel 40 and a rear panel 42. The front panel is formed of an elastic material, such as a knitted NYLON fabric. The rear panel 42 is formed of a waterproof material and is preferably inelastic, e.g., a woven NYLON fabric. The front panel and the rear panel are connected together at a sewn seam 44 on each side of the covering. The top edge of the tubular portion 38 forms an opening 46 which is preferably elasticized. To that end, an elastic band, such as a polyester fabric piping is sewn around the opening forming the top edge of the covering 20. The opening 46 is arranged to receive a portion of the head gear crown 26 therethrough and to tightly engage it to hold the tubular portion 38 of the covering in place on the crown. When the covering is disposed on the head gear 20 as shown in FIG. 1 the elastic front panel 40 overlies the front portion of the head gear and stretches somewhat to accommodate the brim 32. In addition, the under edge of the front panel which is in the form of a piping 48 (to be described later) extends under the rim 28 of the head gear in the brim area to contact or lie in close proximity to the brow of the wearer, thereby sealing the interior of the head gear from the ingress of cold or water.

The rear panel 42, as noted heretofore, is formed of a relatively inelastic fabric and may include one or more sections which are joined together. In the embodiment shown herein the back panel 42 comprises two similar sections 50 and 52 which are joined together at a vertical sewn seam 54 (FIG. 2). It must be pointed out at this juncture that the rear panel 42 may be formed of any number of sections, as desired.

As can be seen clearly in FIGS. 1 and 2, the rear panel 42 comprises a pair of flaps 56 and 58 extending downward from the tubular portion 38 on each side of the covering while also extending in a slightly forward direction, that is in the direction of the elastic front panel 40. The flaps 56 and 58 are connected together at the rear of the covering 20 by a web portion 60. The height of the web, that is the distance between the portion of the web contiguous with the bottom of the head gear 22 and the bottom edge 62 of the web is of a suitable dimension such that when the covering 20 is in place on the wearer as shown in FIG. 1 the web 60 covers fully the back of the wearer's head and neck and down to the nape of the neck. The free edge of the rear panel is edged with piping 48. The piping 48 is held in place by a stitch line 64 and is formed of the same fabric as the rear panel.

In accordance with a preferred aspect of the instant invention the rear panel 42 includes a thermally insulative lining 66 (FIGS. 3 and 5) such as a Raschel knitted fabric.

As can be seen in FIGS. 1, 2 and 5, releasable fastening means are provided on the flaps 56 and 58 adjacent their free ends to effect the securement of the flaps together. When the covering is in place as shown in FIG. 1 with the flaps secured together the covering 22 effectively forms an insulated enclosure for all of the wearer's head (except for his face which extends through the opening formed between the flaps) as well as for all of his neck down to the nape and with the piping forming a weather seal around his face.

In accordance with a preferred aspect of this invention the releasable securement means comprises a two component hook and loop fastening tape, such as that sold under the Trademark VELCRO. To that end, one component 68, such as the hook component of the tape is permanently secured to the outside surface of flap 56 adjacent the piping 48 at the front thereof. The component 68 may be secured by any conventional manner, such as stitch lines 70. The other component 72, that is the loop component, of the tape is permanently secured to the inside surface of the other flap 58 adjacent to the free end thereof. Like component 68 component 72 is preferably sewn in place. In the interests of accommodating various head sizes and features the flaps are arranged for securement at any point along a substantial length of the free end of flap 56 to create various sized face openings. To that end, the component 68 preferably extends along a substantial length of the piping 48 adjacent the free end of the flap 56. Needless to say, this feature is of substantial importance for ensuring a good fit on the wearer.

In accordance with another aspect of this invention the back panel 46 is made sufficiently flexible such that the flaps 56 and 58 may be folded upward and out of the way like that shown in FIGS. 3 and 4. In order to hold the flaps up and out of the way the free ends of the flaps are inserted between the elastic band 46 and the crown 22 as shown in FIG. 3. This is of considerable importance in that it enables the covering to be left in place on the crown when the weather is warm and dry and the wearer doesn't need to be covered.

As should be appreciated from the foregoing the hard head gear covering of the instant invention is simple in construction and can be utilized with various sized and shaped hard head gear. Furthermore, the covering is simple to put on or take off of hard head gear and does not require special connection means to hold it in place. In addition, when the covering of this invention is in place on hard head gear it can quickly be arranged to provide maximum weather protection by merely connecting the flaps together adjacent the chin. When weather conditions improve the flaps can be disconnected and simply folded up out of the way, thereby uncovering the wearer, and without necessitating the removal of the covering from the head gear.

Without further elaboration, the foregoing will so fully illustrate my invention that others may, by applying current or future knowledge, readily adapt the same for use under various conditions of service.

What is claimed as the invention is:

1. For use in combination with hard head gear including a crowned portion terminating in a free edge which forms a brim in the front thereof, weather-protective covering which is placed on the head gear or removed therefrom while the head gear is worn and comprising a flexible tubular portion including a front panel formed of an elastic material and a rear panel formed of an inelastic, outer layer of a waterproof Nylon and a liner of a thermally insulative material, said tubular portion also including an elastic opening at the top formed by a band of elastic material, said tubular portion being adapted to be disposed over said head gear while said head gear is worn, with the crown extending through the elastic opening and with the elastic front panel of the covering disposed over and accommodating the brim, said rear panel also comprising a pair of flaps extending downward and forwardly from the tubular portion on opposite sides thereof and being joined at the rear thereof by a web portion, each of said flaps terminating in a relatively narrow free end and including readily disconnectable connection means at their free ends to enable the flaps to be connected together adjacent the wearer's chin, whereby the flaps and the connecting web cover the sides of the wearer's face and the back of the wearer's head and neck, said flaps and interconnecting web being sufficiently flexible to enable the flaps and web to be bent upward with the flaps outside of said head gear and with their free ends bent downward and inserted between the elastic band and the crown portion of the head gear to hold the flaps outside the head gear and thereby expose the sides of the wearer's face and the back of the wearer's head and neck.

2. The weather protective covering of claim 1 wherein the releasable fastening means comprises a two component fastening tape.

3. The weather protective covering of claim 2 wherein said front panel is formed of a knitted material.

4. The weather protective covering of claim 1 wherein said rear panel is brightly colored.

5. The weather protective covering of claim 4 wherein said color is florescent.

* * * * *